United States Patent [19]

Ramesohl et al.

[11] Patent Number: 4,508,503

[45] Date of Patent: Apr. 2, 1985

[54] INTAKE ASSEMBLY FOR ROTARY DRUMS

[75] Inventors: Hubert Ramesohl; Fritz Seelen; Ralf Filges, all of Bergisch Gladbach; Karlheinz Schröder; Elmar Veiser, both of Cologne, all of Fed. Rep. of Germany

[73] Assignee: Klockner-Humboldt-Deutz AG, Fed. Rep. of Germany

[21] Appl. No.: 546,107

[22] Filed: Oct. 27, 1983

[30] Foreign Application Priority Data

Dec. 10, 1982 [DE] Fed. Rep. of Germany ..... 3245702

[51] Int. Cl.[3] ..... F27B 7/36; F27B 7/02

[52] U.S. Cl. ..... 432/109; 432/106

[58] Field of Search ..... 432/103, 106, 115, 118, 432/109

[56] References Cited

U.S. PATENT DOCUMENTS

| | | | |
|---|---|---|---|
| 2,266,396 | 12/1941 | Lincoln et al. | 432/115 |
| 2,826,403 | 3/1958 | Moklebust | 432/116 |
| 3,436,061 | 4/1969 | Zinn | 432/106 |
| 3,547,417 | 12/1970 | Elkjaer | 432/106 |

*Primary Examiner*—John J. Camby

*Attorney, Agent, or Firm*—Hill, Van Santen, Steadman & Simpson

[57] ABSTRACT

The present invention deals with a chute for a kiln intake housing of a rotary tubular kiln or the like, the chute having a lining composed of a refractory material and a double-walled, inwardly facing collar disposed at the lower end thereof, the collar functioning to support the lower end of the refractory lining within its metal jacket and the collar being equipped with a special coolant circulating device. The inner end of the collar is composed of support segments which are connected to each other and to a holding means, the interior space of the collar being subdivided as required in order to provide for an induced circulation of a coolant.

6 Claims, 6 Drawing Figures

INTAKE ASSEMBLY FOR ROTARY DRUMS

BACKGROUND OF THE INVENTION

1. Field of the Invention

This invention is directed to an intake for rotary drums for thermal treatment of material such as tube radiators, rotary tubular kilns, and the like, consisting of a stationary or movable housing surrounding an intake opening of the rotary drum, together with a chute which is a provided with a refractory lining and arranged to direct the material to the intake opening of the rotary drum.

2. Description of the Prior Art

Product intake chutes, for example, at cooling drums which follow a cement clinker calciner are subject to a high, mechanically abrasive thermal load which may result in a progressive erosion of the lining, particularly in the area of the discharge end. This wear is partially produced by the impact of falling pieces of large cement clinker which leave the calciner and proceed into the cooling drum. When the thickness of the refractory lining falls below a minimum dimension, permanent deformations of the outer jacket can occur due to excessive thermal stresses so that replacement of the chute becomes necessary.

There has been a suggestion to protect the discharge area of rotary tubular kilns, for example, by providing air cooled protector segments disposed on brackets, the segments directly following the end of the kiln jacket and thus forming a discharge ring. The protector segments not only prevent an overload at the actual end of the kiln jacket but also simultaneously form an absorpotion point for the axial thrust developed by the rotary tubular kiln lining. This is accomplished by means of inwardly directed cams which are disposed thereon. Such embodiments of a rotary tubular kiln discharge are shown, for example, in the reference "Zement-Kalk-Gips" No. 2, 1975, p. 57.

It has also been suggested to support a stationarily disposed intake chute of a rotary tubular kiln which is covered with a refractory lining and is preceded by a cyclone heat exchanger by means of refractory retaining rings which are disposed at right angles to the flow direction of the material. Webs are welded to the metallic surface of the chute and proceed in the same direction as the refractory retaining rings at certain intervals, and likewise serve to anchor the lining.

SUMMARY OF THE INVENTION

The present invention seeks to improve the known designs of intakes for rotary drums which are charged with hot materials such, for example, as tube radiators, rotary tubular kilns used in conjunction with preheating systems, and the like, to improve the reliability of thermal protection, particularly at the discharge end. The result is an increase in the useful life of such system parts. This is achieved in that the chute includes a metallic jacket which exhibits an inwardly directed, double-walled collar serving to support the lining on the jacket, and at its lower end facing the rotary drum. The clearance of the collar disposed toward the outside of the chute is at least partially open. This hollow box-like structure of the end region of the metallic jacket provides the possibility of providing the region with special cooling as a result of which a thermal overload of the jacket is largely prevented even with erosion of the refractory lining. The dimensional stability of the jacket is thus preserved.

In a preferred embodiment of the invention, the clearance space of the double-walled collar is subdivided into chambers by means of webs, the chambers at least partially communicating with one another. The chamber formation in the area of the double-walled collar serves to guide a coolant which can thus be applied at a plurality of locations along the collar and which can thus likewise be removed at a plurality of locations. The extent of the cooling effect can be thus optimally designed in this fashion.

In a further embodiment of the invention, the collar is composed of support segments. The subdivision of the collar into support segments serves to simplify repair work since it enables the repair to be limited to that area which is actually damaged and in need of repair.

BRIEF DESCRIPTION OF THE DRAWINGS

Further developments and advantages of the present invention will become apparent from the following sample embodiment which is illustrated in the drawings in which.

DESCRIPTION OF THE PREFERRED EMBODIMENTS

Figure 1:
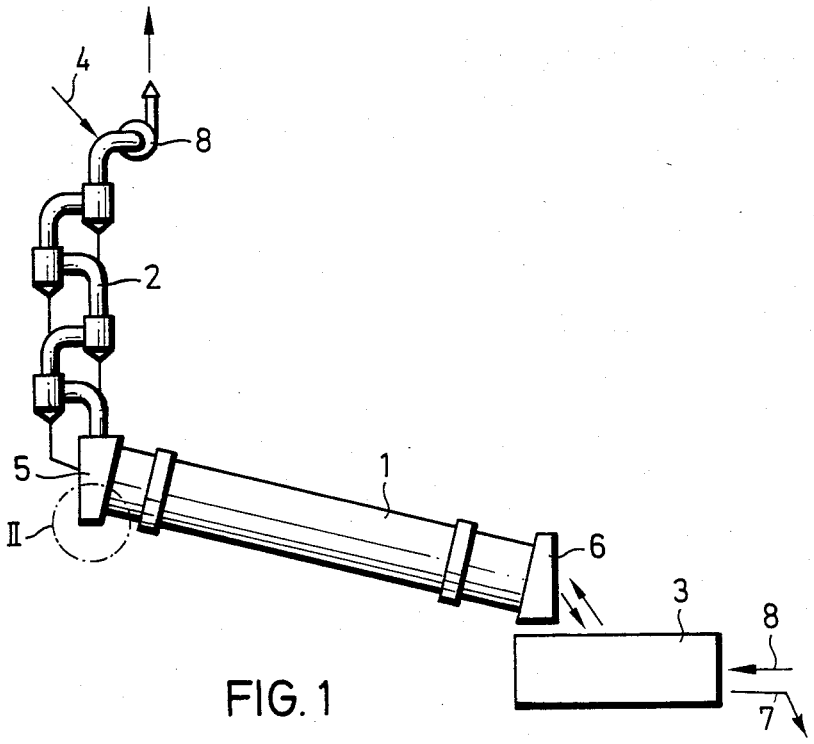
FIG. 1 is a digrammatic showing of a rotary tubular kiln/heat exchanger system for the manufacture of cement clinker which can make use of the intake of the present invention.
Figure 6:
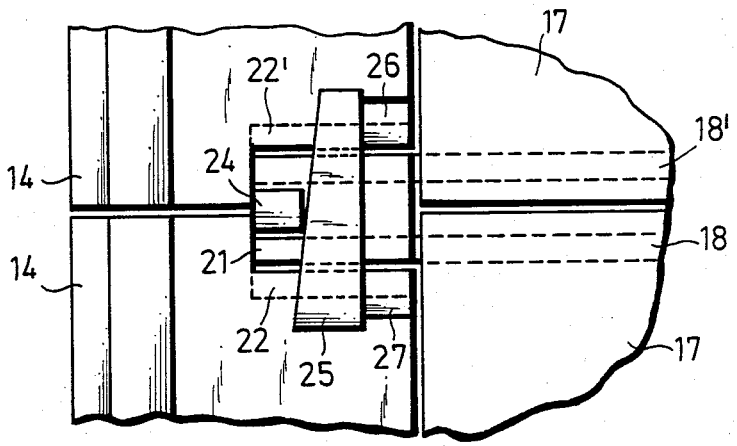
FIG. 6 is a plan view taken along the arrow VI of FIG. 3.

In FIG. 1 there is illustrated a rotary tubular kiln 1 for burning cement clinker which is preceded by a preheating system 2 which in this instance consists of a four-stage cyclone heat exchanger system. The kiln 1 is followed by a cooling unit 3. Raw material to be treated enters the preheating system 2 as shown by the arrow 4, and successively traverses the individual stages of the system 2 and ultimately proceeds into the rotary tubular kiln 1 through a kiln intake housing 5. The preheating system 2 includes firing means (not shown) so that the raw material introduced into the rotary tubular kiln 1 is not only preheated but is already partly calcined as well. The raw material which is completely calcined and sintered in the rotary tubular kiln leaves the kiln 1 through a discharge end 6 and, after traveling through the cooler unit 3, is removed from the system as shown by the arrow 7 for further processing, for example, a clinker grinding. At the same time, air as shown by arrow 8, flows through the cooler unit 3, the rotary tubular kiln 1, and the preheating system 2 in countercurrent flow to the raw materials being treated and is finally recovered through the use of a ventilator blower 8.

Figure 2:
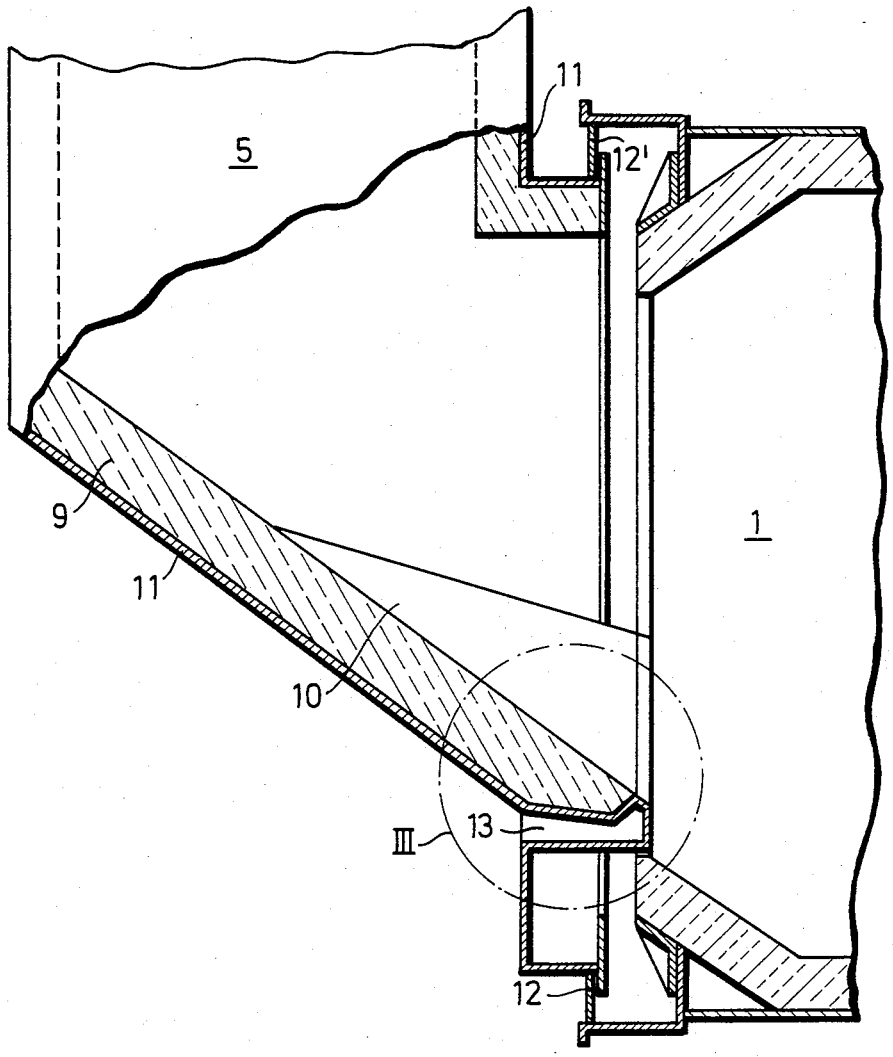
FIG. 2 is an enlarged illustration of that portion of the system of FIG. 1 enclosed within the dot-dash line II of FIG. 1.
Figure 3:
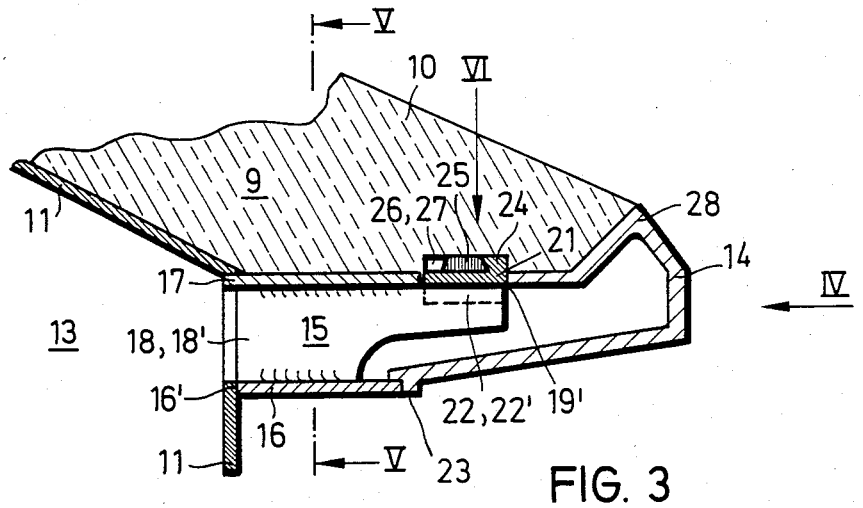
FIG. 3 is an enlarged view of that portion of the structure shown in FIG. 2 included within the dot-dash line III.
Figure 4:
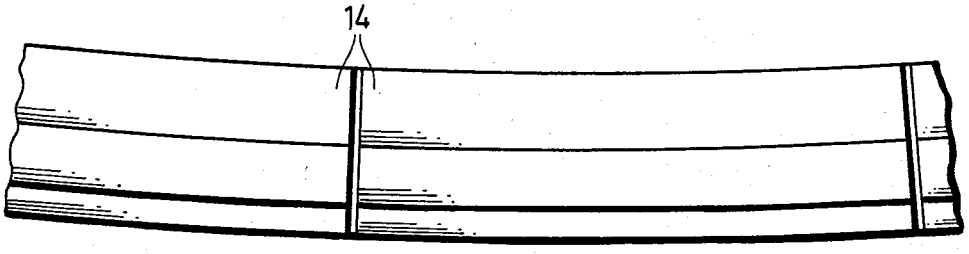
FIG. 4 is a cross-sectional view taken along the line IV of FIG. 3.

The raw material exiting from the preheating system 2 and proceeding into the kiln intake housing 5 is at a considerably elevated temperature, particularly when a partial calcining occurs in the preheating system 2 so that a refractory lining 9 of a chute 10 of the kiln intake housing as illustrated in FIG. 2 is exposed to a high thermal and mechanical, abrasive load. The chute 10 includes a metallic jacket 11 which has the profile of a conical surface to which the refractory lining 9 is anchored in a suitable, known manner.

Seals 12 and 12' are provided to produce a gas-tight connection between the rotating rotary tubular kiln 1 and the stationary kiln intake housing 5.

The lower end of the jacket 11 which terminates at the inlet to the kiln is formed into an inwardly and approximately horizontally directed, double-walled collar 13 which serves to restrain the lining 9 from any downward sliding movement. The material of which the collar consists must be of such a nature that it retains sufficient solidity and dimensional stability even when partial erosion of the refractory lining occurs in the area of the chute 10. To this end, the collar 13 can be equipped with a cooling air circulation to be described in detail later.

FIGS. 3 to 6 show details of the structure of the collar 13. Facing the inside of the kiln, the collar 13 consists of individual support segments which are placed next to each other on a holding means 15. The support segments 14 consist of hollow profile members closed at the kiln side and may be composed of creep resistant cast steel or a reinforced ceramic. The holding means 15 comprises a bearing plate 16 which has the shape of a cylindrical segment and also consists of a series of cover plates 17 which are disposed along a line spaced from and concentric to the bearing plate 16. Webs 18, 18' form brackets 19 in respective pairs and are situated between the bearing plate 16 and the cover plates 17 to bridge the distance therebetween. The webs 18, 18' are welded both to the bearing plate 16 as well as to the cover plates 17 and extend at least partially into the zone of the support members 14 on the kiln side. Such webs proceed essentially from the outer edge 16' of the bearing plate 16. Thus, the webs 18, 18' assume the function of partitions by means of which individual chambers are formed along the collar 13 in that the webs 18, 18' are extended into the zone on the kiln side of the support segments 14. These chambers which can be combined in groups for the purpose of circulating a coolant therethrough thus provide improved thermal protection for the collar 13 and, consequently, of the discharge area of the chute 10. The chambers can further be equipped with built-in units for guiding a coolant therethrough.

Figure 5:
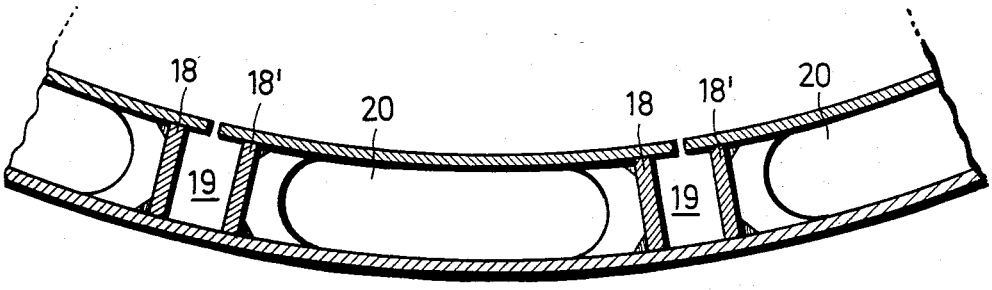
FIG. 5 is a cross-sectional view taken along the line V—V of FIG. 3.

As shown in FIG. 5, the space remaining between two brackets 19 communicates with the outer space over oblongtype openings 20. Both the bearing plate 16 as well as the cover plates 17 are welded to the jacket 11 of the chute 10 or to some other stationary part of the kiln intake housing 5.

Two webs 18, 18' forming a bracket are connected by a rectangular plate 21 at an area near the kiln end, with the plate 21 being welded thereto. Two mutually adjacent support segments 14 partially cover the plates 21 and are supported against support surfaces 22, 22' which extend away from the brackets 19 at both sides of the webs 18, 18' at the level of the upper edge 19' of the brackets 19. The support elements are further supported against the bearing plate 16 by means of a suitable corner iron.

Also situated on the plate 21 is a cam 24 against which a wedge 25 is pressed by its cooperation with further cams 26 and 27 disposed at the side facing away from the cam 24. The cams 26 and 27 are respectively situated on mutually adjacent support segments 14. The support segments 14 thus form a firm union held together by the wedges 25 and also form the kiln-side termination of the clearance between the bearing plate 16 and the cover plates 17.

The support elements 14 are equipped with a nose structure 28 for securing the lining 9 of the chute 10. The cams 24, 26 and 27 are designed such that a dovetail guidance is provided for the wedge 25. In this manner, the support segments 14 also provide locking with respect to the direction perpendicular to the plane of the drawing of FIG. 6.

It should be evident that various modifications can be made to the described embodiments without departing from the scope of the present invention.

We claim as our invention:

1. An intake assembly for introducing materials into a rotary drum which includes:

a housing arranged to discharge into an intake opening of said rotary drum, a chute forming the discharge end of said housing, said chute including a metal jacket and a refractory lining on said jacket, said jacket including a double-walled collar composed of individual support segments and restraining said lining from downward sliding movement, said collar having a closed end facing the rotary drum and having at least a partially open end toward the outside of said chute, webs subdividing said double-walled collar into separate chambers, holding meand confining said support segments, and clamping means for securing said holding means to said jacket.

2. An intake assembly according to claim 1 in which said clamping means includes a wedge-type connection.

3. An intake assembly according to claim 2 in which:

said wedge-type connection includes a plate connecting two adjoining webs and secured thereto, and a plurality of fastening elements positively locked to each other on at least one support segment.

4. An intake assembly according to claim 1 wherein said holding means includes a bearing plate in the form of a segmented cylinder and cover plates opposite said bearing plate in spaced relation and on a line concentric thereto.

5. An intake assembly according to claim 4 wherein said webs are disposed between said bearing plate and the cover plates and bridge the clearance therebetween in the radial direction.

6. An intake assembly according to claim 5 wherein said webs extend at least partially into the area of said support segments.

* * * * *